US006008586A

United States Patent [19]

Norman

[11] Patent Number: 6,008,586

[45] **Date of Patent: *Dec. 28, 1999**

[54] DIRECT CURRENT BALLASTLESS MODULATION OF GAS DISCHARGE LAMPS

[76] Inventor: Richard J. Norman, 215 St. Andrews Blvd., Winter Park, Fla. 37292-4201

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,532

[22] Filed: Feb. 6, 1997

[51] Int. Cl.[6] ..... H05B 37/02

[52] U.S. Cl. ..... 315/94; 315/95; 315/98

[58] Field of Search ..... 315/94, 95, 307, 315/291, 101, 102, 103, 97, 98, 46, 47, 48, 49, 51, 250, 251, 312, 324

[56] References Cited

U.S. PATENT DOCUMENTS 4,187,448 2/1980 Kuroi et al. ..... 315/176

5,424,611 6/1995 Moriarty ..... 315/94

*Primary Examiner*—David H. Vu

[57] ABSTRACT

The present invention relates to an apparatus and method for receiving a modulating signal, splitting up its various frequency components into separate channels using a plurality of filters, and applying the outputs of the filters to gas discharge lamp modulating circuits to analogously vary the light output of each lamp. The present invention processes the modulation signal through a control circuit, a peak voltage detector, a current source, an ionization voltage supply, a filter circuit, a voltage multiplier and a modulating circuit to the gas discharge lamps. Optocoupling elements are implement in the present invention to control the circuitry. The gas discharge lamps have a rectifying element connected between each gas discharge lamp to prevent the gas discharge lamps from being connected to neutral by the filament of an adjacent gas discharge lamp.

28 Claims, 4 Drawing Sheets

DIRECT CURRENT BALLASTLESS MODULATION OF GAS DISCHARGE LAMPS

FIELD OF THE INVENTION

The present invention relates to a circuit and method for modulating the light output of a plurality of any size of hot cathode gas discharge lamps in response to an input modulating signal, rendering an analogous visual representation of the modulation signal.

BACKGROUND OF THE INVENTION

Various techniques are used to modulate light output from incandescent, gas discharge, and other types of lamps by attempting to analogously match light output to the voltage or energy level of a modulating signal. Much success has been attained with incandescent lamps in particular, due to the ease of powering a positive-resistance device. However, due to the filament heat persistence of the incandescent lamp, it is difficult to track light output quickly and directly with modulation signal input. Plasma type lamps are more suited for this task, as there is no filament heat persistence in the plasma. The difficulties to be overcome in using hot cathode gas discharge lamps are numerous when compared to their incandescent counterparts. In the prior art, several methods of modulating light output from various types of light emitting elements have been proposed, all of which suffer from a number of limitations and disadvantages.

Methods wherein gas discharge lamps are modulated have usually included the use of inductive or inductive/electronic/dimming type ballasts as a part of their modulation output circuitry. This significantly increases the cost, weight, and size of such devices. Such devices with ballasts also rely on the classic continuous grounded fixtures to initially ionize the lamp gasses, restricting the total viewing angle to 180 degrees or less. In other prior art wherein ballasts have been eliminated, there is no provision for heating lamp cathode filament(s) by a method other than lamp ionization current. For systems that heat lamp cathode filament(s) solely by lamp ionization current, the power necessary for heating lamp cathode filaments and causing electron emission from the lamp cathode filaments must be provided by a minimum value of lamp ionization current multiplied by the "cathode fall" voltage. That minimum ionization current value, as specified by -as discharge lamp manufacturers, is near ½ of the maximum rated lamp current.

This leaves little range for continuous, reliable modulation of the light output below that minimum level. When the ionization current decreases to below the minimum necessary to keep the electrodes hot enough to continue to emit electrons, lamp ionization current is extinguished. Consequently, systems which provide heating of lamp cathode filaments solely by lamp ionization current have a modulation range that is limited to the upper half of the lamps light output range. Due to the logarithmic response of the eye to light, the changes in light output that could be made in such a system would be only moderately perceptible.

Many Prior Art apparatus include the use of a diode in the final filter stage or modulation stage. Not only does this arrangement restrict the modulation circuit's use to just one excursion of the modulation signal, it also limits the dynamic range of any modulation signal processed. Thus, if the voltage output of the last filter stage is 6.0 VAC, the dynamic modulation range is restricted to 6.0 VAC divided by 0.6 VAC (the forward diode drop), or 10 times, or 20 dB (voltage). This is due to the fact that the output of the final filter stage or output buffer must first exceed the diode drop before modulation begins to occur.

Many such apparatus require a high input modulation signal voltage for proper light modulation, and some provide no automatic level control. Also in the prior art, no provision is made to utilize the modulation signal for anything other than automatic gain control, and input to the modulation circuitry. No provision for a power-save feature is present in prior art references using ballasts.

Some apparatus provide no means to increase the ionization potential beyond line voltage, restricting the length of lamp that can be ionized. Many do not provide a means for minimally sustaining lamp ionization current, or provide no internal operating current source for the lamp's main ionization current requirements.

Much prior art provides means for modulation wherein one leg of the AC mains is connected to low voltage ground. This creates a "hot ground" and a potential for problems should breakdown occur.

In the Prior Art which lacks the use of a ballast of any kind, and in which infinite analog modulation occurs, such apparatus suffer from the disadvantage of undesirable power dissipation in the power switching component which sources ionization current to the gas discharge lamp. This is due to the lack of the apparatus' ability to decrease ionization voltage to the lamp as the ionization current through the lamp increases. This would be the normal function of the ballast.

SUMMARY OF THE INVENTION

The present invention relates to an apparatus and method for receiving a modulating signal, splitting up its various frequency components into separate channels using a plurality of filters, and applying the outputs of the filters to gas discharge lamp modulating circuits to analogously vary the light output of each lamp.

To initially ionize all gas discharge lamps, a circuit is provided such that high voltage pulses are emitted from a transformer from the time a modulating signal of a predetermined level is present until a predetermined time afterward. After ionization, a minimum sustaining ionization current is provided by resistors in parallel across the emitter and collector of each output transistor.

Heating of lamp cathode filaments is accomplished by a thyristively controlled circuit which, in turn, is controlled by the modulating signal. During operation, lamp cathode filaments current (a current common to all cathode filaments) flows into a controlled voltage multiplier circuit.

Automatic attenuation of the input modulating signal is accomplished by a diode-biased negative output peak detector circuit. This circuit gives the present invention the ability to process input modulating signals from 0.0 VAC to 100 Volts AC.

Modulation is achieved by connecting the output from the automatic attenuator to a series of multiple feedback bandpass filters, then applying the filter outputs to voltage-to-current converter circuits. The converter circuits then provide bipolar currents into optoisolators. Thus, both the positive and negative excursions of the modulating signal are used to modulate the light output of the lamps.

Accordingly, several objects of the present invention are; to provide a method of modulating lamp ionization current from 0.1% of rated lamp maximum to rated lamp maximum, thereby expanding dynamic range of light modulation; to provide a method of modulating lamp ionization current without the use of inductors in the lamp modulation circuits, thereby eliminating the need for costly and bulky inductive circuits; to provide a method for reducing lamp ionization voltage by an amount proportional to increases in lamp ionization current, thereby saving energy and dissipating less heat; to provide a method for viewing lamps at all angles except those wherein one lamp must block the view of the next lamp; to provide a method such that, a predetermined time after the modulating signal decreases below a predetermined level, lamp filament current is reduced to 0.0 Amps, thereby lengthening filament life, thereby reducing power consumption for the entire preferred embodiment to less than 2 Watts, and thereby allowing users of the present invention the convenience of energy savings while the present invention remains connected to AC mains and powered up; to provide an automatic attenuator circuit capable of handling an input modulating signal from 0.0 VAC to 100 VAC, thereby rendering the present invention almost immune from damage by high input modulation voltages; to provide a method of heating lamp cathode filaments other than solely by lamp ionization currents, thereby making it possible to modulate lamp light output down to the lamp's lowest possible output range; to provide a method of heating lamp cathode filaments wherein filaments are series-wired, thereby eliminating the need for multiple cathode filament transformers; to provide a method wherein gas discharge lamps of any size can be free-standing, thereby eliminating the requirement for multiple ballast fixtures; to provide a method for instantaneous analog control of ionization current by the input modulation signal, thereby facilitating a means of processing all frequencies contained in the modulating signal with equal effectiveness; to provide a method for increasing the number of gas discharge lamps in the present invention by adding only each lamps associated modulating circuitry; to provide a method of incorporating a plurality of gas discharge lamp cathode filaments connected in series into the lamps' ionization voltage supply, thereby reducing ionization voltage proportionally as ionization current increases; to offer any users of the present invention the convenience of being able to operate it remotely using only the modulating signal for controlling all features of the present invention; to provide a method of filtering and modulating wherein both the negative and positive excursions of the modulating signal are used to modulate light output, thereby rendering a more complete and accurate correlation between energy contained in the modulating signal waveform and the light output of each lamp; and to provide a method of modulation wherein diode voltage drop is eliminated, thereby expanding the dynamic range of light modulation at lower levels of modulating signal amplitude.

The limitations and disadvantages of the prior art are overcome by incorporating a series-connected plurality of gas discharge lamp cathode filaments, heated independently of lamp ionization current, to perform several useful and necessary functions of the present invention. An automatic attenuator circuit is provided which accepts a very wide dynamic range of modulating input signal. This allows the user to connect the present invention to almost all practical signal sources without regard to signal level compatibility.

The necessity for a ballast of any kind has been eliminated, resulting in a multitude of advantages. Cost, weight, and size can be reduced. The need for a standard gas discharge fixture and its inherent ground plane has been eliminated, allowing all lamps to be viewed from any angle. Additional gas discharge lamps can be incorporated into the preferred embodiment by simply adding the corresponding filter and modulating circuitry.

In one embodiment, the filter circuits are geometrically staggered to include the total spectrum of the input modulating signal. The use of voltage-to-current converters and AC input optoisolators in the front end of the modulation circuitry has several advantages. It allows both negative and positive excursions of the modulating signal to be included in the modulating process. Since most modulating signals have morphologies wherein the positive excursion differs from the negative excursion, the advantage of this arrangement is it's ability to render light output that is a representation of the energy contained in the entire waveform, not just half of it. Use of voltage-to-current convertors also allows modulation to begin at filter output voltages below 10.0 mV, resulting in a wide dynamic range. Furthermore, the optoisolators provide 5000 Volts of isolation between the low voltage circuitry and the lamp modulation circuitry. This is a distinct advantage in the event of a breakdown of transformer T1.

In one embodiment, the use of bipolar transistors as the output modulating components allows continual and instantaneous analog control of lamp ionization current. The modulation signal controls not only the modulation circuitry and automatic attenuator circuit, it also controls circuitry used to initially ionize all lamps and circuitry used to control power saving features.

Potential users of the present invention need merely plug the device into a standard household 120 VAC outlet and provide a wide range of input modulating signal. The present invention will automatically provide the proper electronic environment for optimal interface between modulating signal and gas discharge lamp light modulation. In addition, while the present invention is left plugged in and turned on, it will consume virtually no power without the presence of a modulating signal.

BRIEF DESCRIPTION OF THE THE DRAWINGS

The present invention will now be described by reference to the following drawings.

DETAILED DESCRIPTION OF THE INVENTION

Figure 1:
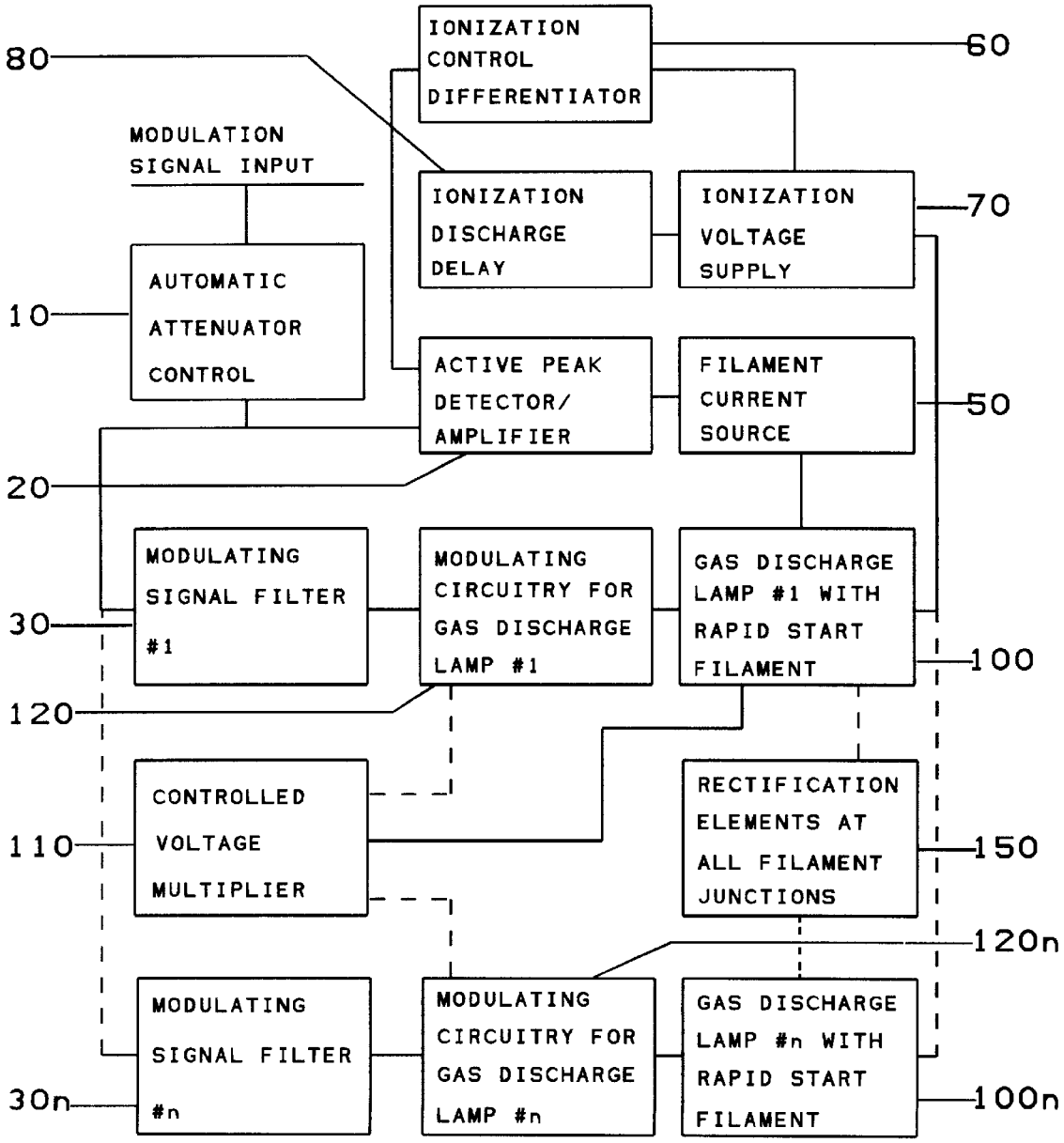
FIG. 1 is a block diagram of an embodiment of the present invention.

Referring to FIG. 1 there is shown a block diagram of an embodiment of the present invention. Each block represents a circuit or component found in the schematic diagram of FIGS. 2A–2C, with reference to the designated references of the devices in FIGS. 2A–2C. The modulation signal enters the apparatus through the automatic attenuator control 10, which is comprised of amplifier A1 and its associated circuitry, and optocoupler element 11. After receiving the modulation signal, this circuit attenuates the modulation signal to a level that is optimal for the dynamic range of operation for the active peak detector/amplifier 20 and all modulating signal filters 30. Attenuation is effected by varying the resistance of optocoupler I1's resistive element, which, in conjunction with R1, form a voltage divider network.

The active peak detector/amplifier 20 is comprised of A4 and its associated circuitry. This circuit receives the output signal of the automatic attenuator control 10. It then amplifies this signal and develops a DC voltage equal to the signal's peak multiplied by the ratio of R15/R16. The gain of A4 is fixed so that when an input modulating signal exceeds a predetermined minimum level, the output of the active peak detector/amplifier 20 is at its maximum value: the positive supply rail. Capacitor C 10 stores the peak voltage, and A3 buffers this peak voltage. As long as there is a minimum level of input signal to the active peak detector/amplifier 20, its output will approximate the positive supply rail. This is necessary for controlling the filament current source 50 and ionization control differentiator 60. When the modulating signal input to the active peak detector/amplifier 20 decreases to 0.0 volts, its output voltage begins to decrease. After a predetermined time, its output decreases to near zero.

The ionization control differentiator 60 is comprised of A2 and associated components, including C8 and R14. It receives the output of the active peak detector/amplifier 20. When a viable modulation signal is first presented to the present invention, a DC voltage immediately develops at the output of the active peak detector/amplifier 20. This DC voltage is presented to the input of the ionization control differentiator 60. For the first 5 to 10 seconds of the initial presentation of modulation signal, the ionization control differentiator 60 output is sufficient to control the ionization voltage supply 70 and cause it to produce high voltage pulses. Should the modulation signal decrease below a predetermined level for a predetermined time, the differentiator 60 is reset and is able to repeat the control cycle.

The ionization voltage supply 70 is comprised of T2, SCR1, I2, and all their associated components. The ionization voltage supply 70 is controlled by two circuits: the ionization control differentiator 60 and the ionization discharge delay 80. Its purpose is to provide a high voltage ionization pulse to initially ionize the gases in all the gas discharge tubes. Two conditions must exist before high voltage pulses are emitted from the ionization voltage supply 70: there must be a viable output from the ionization control differentiator 60, and the ionization discharge delay circuit 80 must remove the shunting signal from the gate of SCR1.

The ionization discharge delay 80 is comprised of I10 and C47. Its purpose is to delay the output of the ionization voltage supply 70 by delaying firing of SCR1 until C5 has attained full peak line voltage. This ensures the condition of maximum high voltage output from the ionization voltage supply 70.

The filament current source 50, comprised of SCR3, I3, and associated components, receives the output from the active peak detector/amplifier 20. The filament current source 50 provides a common current which heats all of the series-connected gas discharge lamp filaments 100. The output of the filament current source 50 is connected to the filament of gas discharge lamp 100 #1, the first in the group of series-connected filaments. Filament current is flowing only when there is a minimum level of modulation signal input. Should the input modulation signal decrease below that level, filament current decreases to 0.0 Amps within a predetermined time.

The controlled voltage multiplier 110 is comprised of SCR2 and associated components, C6, D3, and C4. In conjunction with the series connected gas discharge lamp cathode filaments, it comprises the heart of the present invention. The controlled voltage multiplier 110 provides the main ionization supply voltage for all gas discharge lamps 100. It is infinitely adjustable from peak line voltage to twice peak line voltage. The first stage of the controlled voltage multiplier 110 is connected to the first gas discharge lamp filament in the group of series-connected filaments. The current flowing through the first stage of the controlled voltage multiplier 110 must flow through all gas discharge lamp cathode filaments, eventually to neutral line. The output of the controlled voltage multiplier 110 is connected to the modulating circuitry of every gas discharge lamp in the present invention.

The modulating circuitry 120 for gas discharge lamp 100 #n is exactly the same for all lamps. It is comprised of a voltage to current converter, an optoisolator, and a current limited bipolar transistor. The voltage to current converter sources current into the optoisolator, which controls the output element by varying the control current into the output element. The output of the modulating circuitry 120 for gas lamp 100 #n connects directly to the anode of its corresponding gas lamp, and causes the anode's voltage to vary in accordance with the intensity of the modulating signal.

Modulating signal filter 30 #1 is a multipole multiple feedback bandpass filter comprised of A5, A6, A7, and their associated components. It receives the output of the automatic attenuator control 10, and passes a specific band of frequencies on to the input of modulating circuitry for gas discharge lamp 100 #1 in the form of an AC voltage. The modulating circuitry for gas discharge lamp 100 #1 receives this voltage and uses it to control the anode voltage of gas discharge lamp 100 #1.

The purpose of rectification elements 150 at all filament junctions is to prevent the ionization current of one lamp from using the filament of a neighboring lamp as a path to neutral. Removal of these diodes would cause premature filament failure and an excessively high voltage with respect to neutral to appear at all filaments.

Figure 2A:
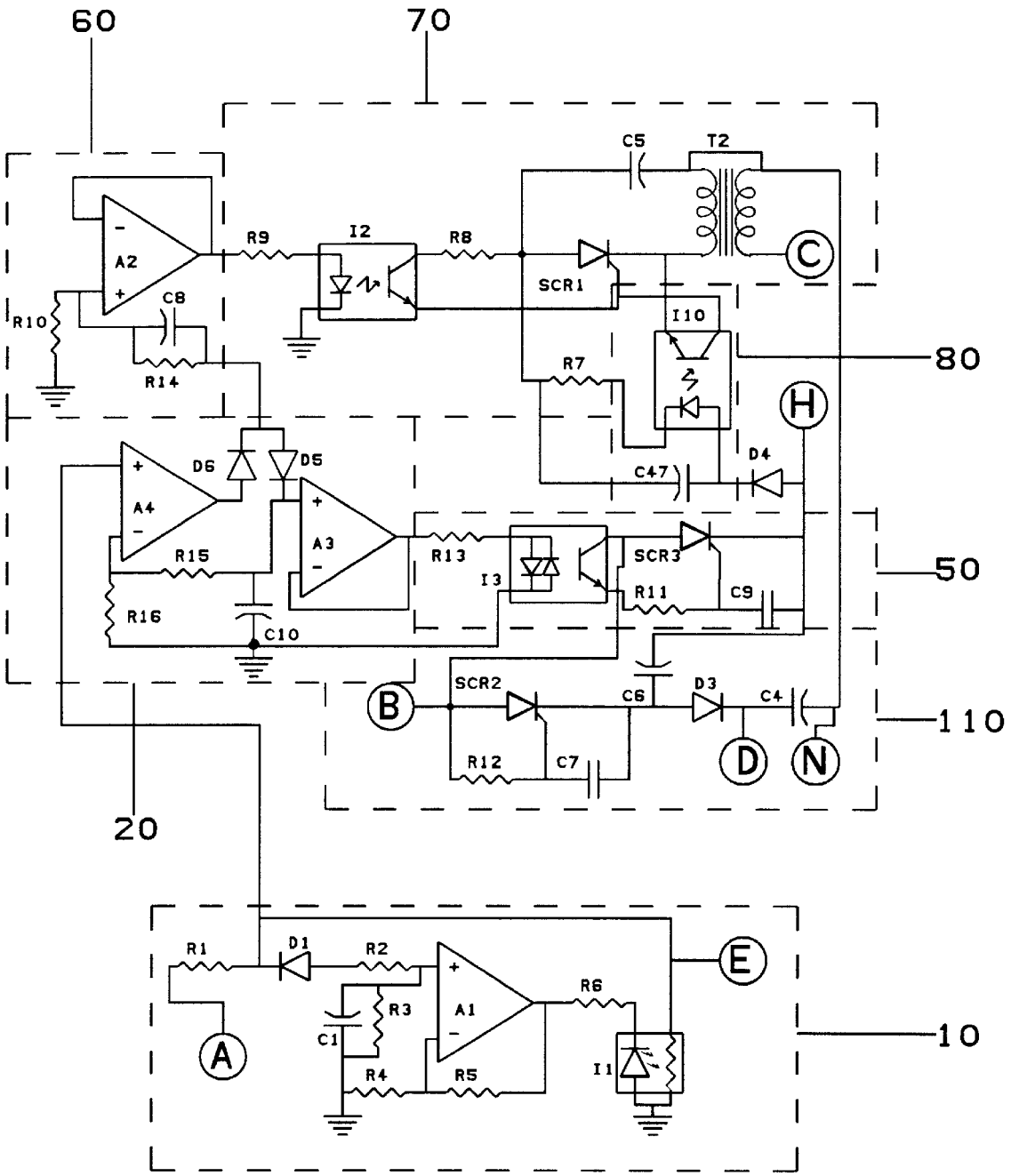
FIGS. 2A, 2B and 2C show a schematic diagram of the circuits contained in the embodiment of FIG. 1.
Figure 2B:
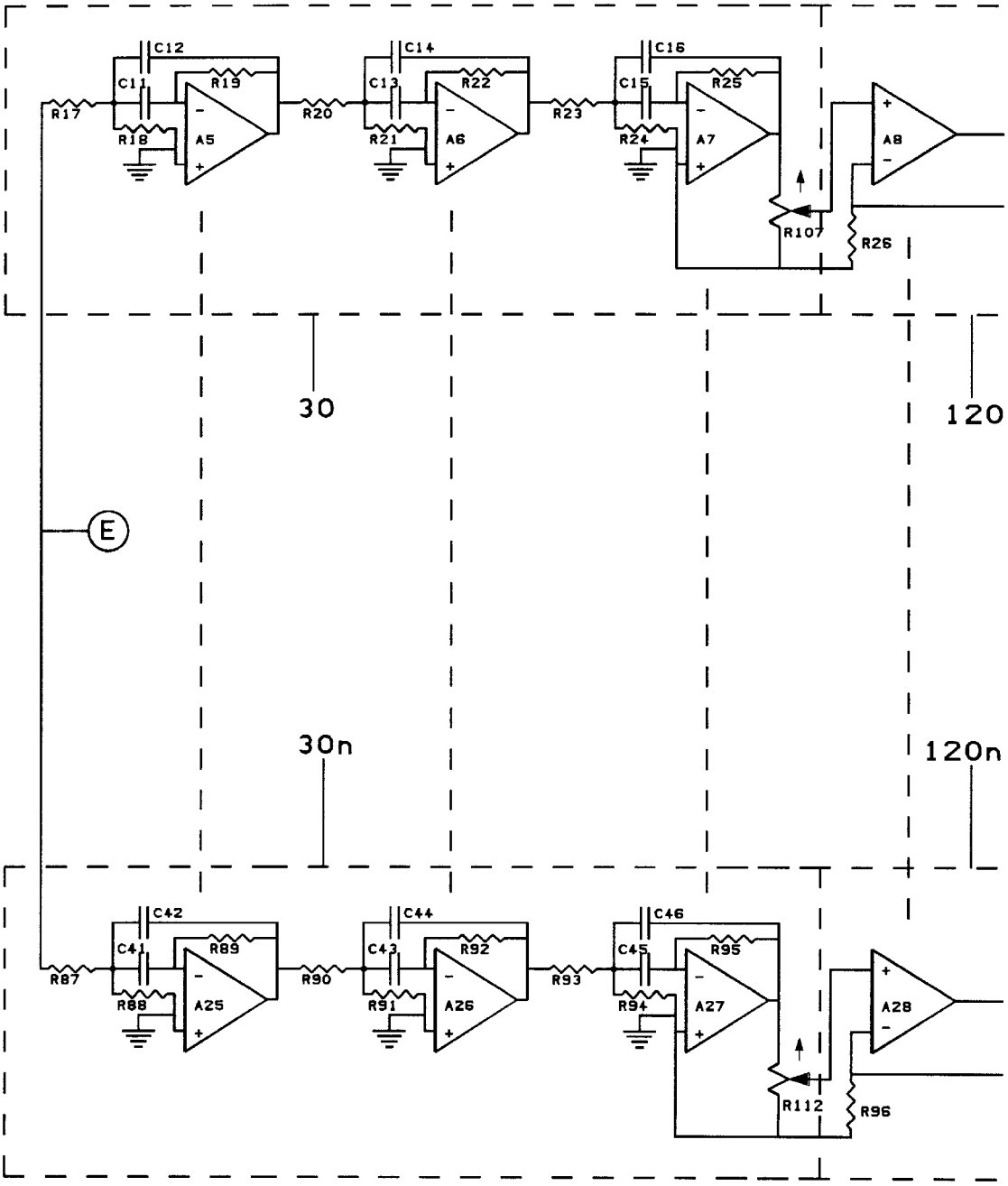
Figure 2C:
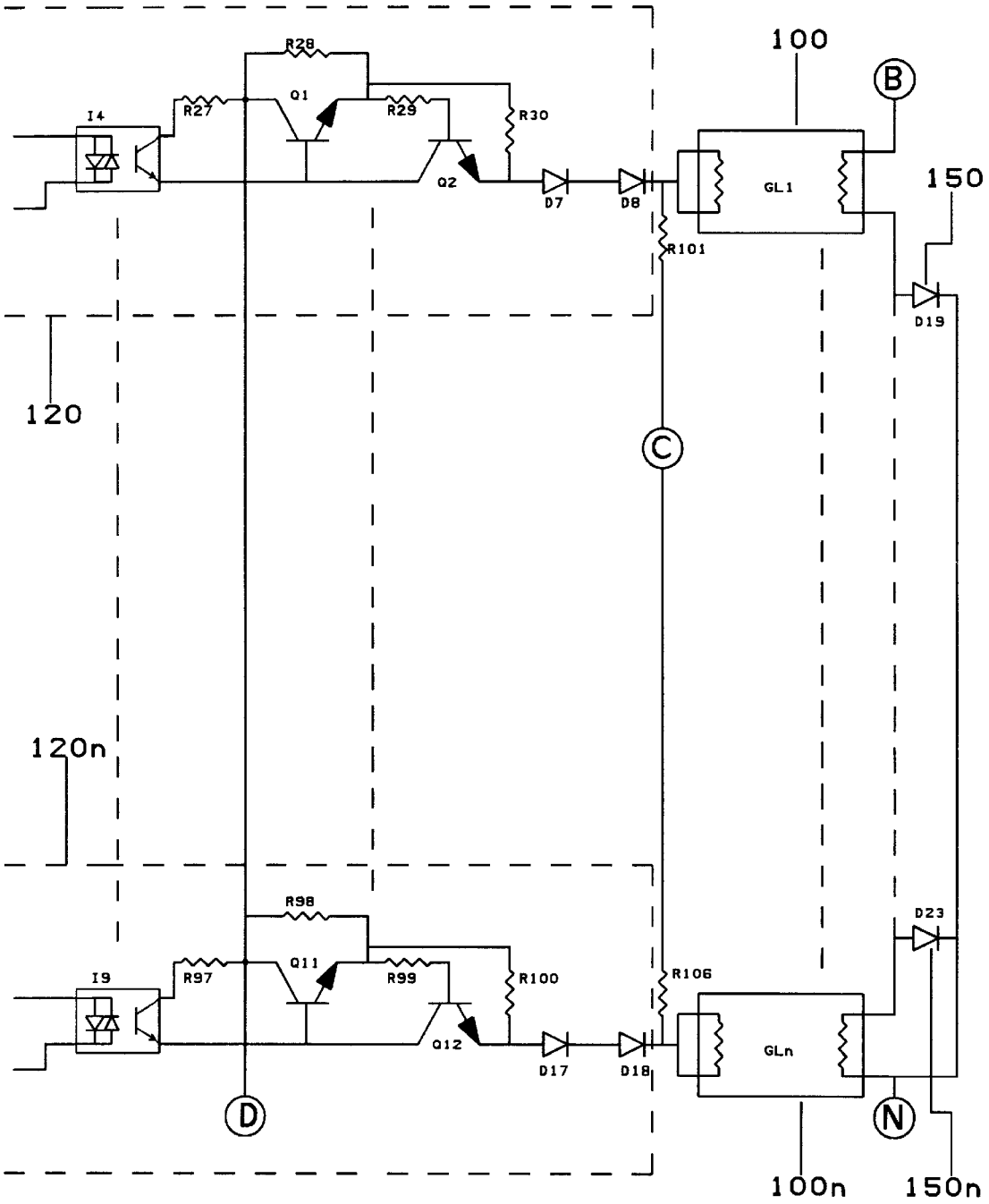

Referring to FIGS. 2A–2C there is illustrated the circuitry utilized to modulate light outputs from a plurality of series connected hot-cathode gas discharge lamps as shown in FIG. 1. This is a diagram of an embodiment, and is not limited to the number of lamps shown.

When designing circuits for operating hot-cathode gas discharge lamps without the aid of a ballast, it is necessary for these circuits to compensate for the ballast's ability to first provide a high ionization voltage and filament current, then to compensate for the ballast's ability to saturate, thereby limiting lamp ionization current and cathode filament current to a predetermined maximum. Part of the circuitry represented by FIGS. 2A–2C integrates the gas discharge lamp cathode filaments into the main lamp ionization power supply as follows:

A silicon controlled rectifier SCR2, a resistor R12, capacitors C4, C6, C7, a diode D3, and the series connected cathode filaments of gas discharge lamps GL1 to GLn comprise a controlled voltage multiplier circuit. Upon initial application of AC voltage to nodes N and H, when hot is negative with respect to neutral, electron current flows from node H, through capacitor C6, through silicon controlled rectifier SCR2, to node B, through all of the series connected cathode filaments of gas discharge lamps GL1 to GLn, to node N. Capacitor C6 is then charged to a voltage determined by the values of resistor R12 and capacitor C7. When hot is positive with respect to neutral, electron current flows from node N, through capacitor C4, through diode D3, through capacitor C6, to node H. Capacitor C4 is then charged to a voltage positive with respect to neutral that is the sum of the peak applied AC voltage plus the voltage across capacitor C6. The moment capacitor C4 achieves the maximum charge set by silicon controlled rectifier SCR2, only a capacitive leakage maintenance current flows through the voltage multiplier circuit. A current greater than the capacitive leakage maintenance current will flow only if an input modulating signal is present. During the presence of a modulating signal, ionization current flows through the lamps, drawing current from node D, depleting the charge on capacitor C4. On the next voltage multiplier charging cycle, capacitor C6 must give up a portion of its charge to recharge capacitor C4. Consequently, the current to recharge capacitor C6 must flow from neutral through the cathode filaments of gas discharge lamps GLl to GLn, through silicon controlled rectifier SCR2, and ultimately through capacitor C6. As a result of high peak currents through the cathode filaments of gas discharge lamps GLl to GLn, there is a corresponding voltage drop across each individual cathode filament. As the sum of all individual gas discharge lamp ionization currents increases, the demand to charge capacitor C4 increases, therefore the demand to charge capacitor C6 increases, and charging current into capacitor C6 increases, resulting in an increased voltage drop across the cathode filaments. As a result of the significant voltage drop across the filaments, capacitor C6 cannot attain its predetermined no-load charge, capacitor C4 cannot attain its predetermined no-load charge, so the voltage at node D is reduced by an amount proportional to the current flowing through the cathode filaments.

Employing the scheme described above has significant advantages. One advantage is that the energy consumed by charging capacitor C6 with high peak currents through a resistive element (series-connected cathode filaments of gas discharge lamps GLl to GLn) is put to good use by providing an integral part of the functionality of the present invention: heating of the cathode filaments. Another advantage is the ability to charge a capacitor using energy from an AC voltage that has been controlled and altered by a thyristive device. Without the resistance of the cathode filaments to limit the high peak charging current into capacitor C6, the excessively high RMS power dissipated by the ESR (equivalent series resistance) of C6 would quickly destroy C6. Yet another advantage, as described above, is the circuit's ability to decrease the main lamp ionization voltage when lamp ionization currents increase. Consequently, there is a significant reduction in the power dissipated in output transistors Ql to Qn due to the decrease in ionization supply voltage at node D. Due to this voltage reduction, there is a significant improvement in efficiency of the present invention.

An amplifier A1, a resistor R1, a diode D1, a resistor P2, a capacitor C1, resistors R3, R4, R5, and R6, and an analog optoisolator I1 comprise a negative peak-detected automatic attenuator circuit. A modulating signal enters through resistor R1. Resistor R1, in conjunction with the photocell inside analog optoisolator I1, form a voltage divider network. Signal rectification is provided by diode D1. Diode D1, resistors R2 and R3, and capacitor C1 comprise a negative peak detector circuit. Upon application of a modulating signal at node A, when the negative excursion of the signal exceeds the forward biased voltage drop of diode D1, a charge begins to accumulate on capacitor C1. As the voltage on capacitor C1 increases, amplifier A1 amplifies this voltage by a factor determined by the ratio of R5/R4. The output of amplifier A1 is connected to the light emitting element in analog optoisolator I1 through resistor R6, which sets a maximurrm current applied through the light emitting element. As current through the light emitting element increases, more photons are emitted, and strike the photocell inside analog optoisolator I1, thus lowering the resistance of the photocell. This effect causes less modulation signal voltage to appear at node E. When node E voltage decreases, there is less input to the cathode of diode D1, so less charge is accumulated on capacitor C1. Input modulating signals below the diode drop of diode D1 (c. 0.6 V) are subject to virtually no attenuation at all, while all other signals are held to peak values at tight tolerances defined by the time constant R2 C1 and the gain of amplifier A1 set by R5/R4. Attenuation of the input modulating signal provides a method of accepting signals of very high amplitude. The circuit described above is capable of attenuating signals from 0.6 VAC to the practical upper limit of the input cable. Attenuating and using the signal directly from the signal source prevents a loss of slew rate that would occur if the modulating signal was processed by a low-quality amplifier. Using this method, all the original signal qualities of the modulating signal are preserved and passed on to the filter and modulating circuits. This is particularly important for frequencies in the upper portion of the modulating signal's frequency spectrum.

An operational amplifier A4, diodes D6 and D5, a capacitor C10, and resistors R15 and R16 comprise an active peak detector. Amplifier A4 receives its input directly from node E, the attenuated modulating signal. The voltage at node E provides a virtually constant average level of input modulating signal voltage to amplifier A4 and all of the filter inputs. Modulation of lamp light output begins to occur when the modulation signal exceeds a predetermined minimum level. When the input of amplifier A4 receives a modulation signal at node E, the signal is simultaneously positively rectified, amplified, and peak detected. Due to the high gain of amplifier A4, the positive voltage across capacitor C10 approximates the positive rail of the amplifier's power supply for modulation signals surpassing the predetermined minimum level.

Operational amplifier A3 is a buffer, and receives the integrated voltage at capacitor C10, buffers it, and drives the light emitting element in optoisolator I3 through resistor R113. The output of optoisolator I3 is connected to a silicon controlled rectifier SCR3 and a resistor R11. Silicon controlled rectifier SCR3, resistor R11, and a capacitor C9 comprise a thyristive control circuit that provides initial cathode filament heating current for the cathode filaments in gas discharge lamps GLl to GLn. Electron current flow through silicon controlled rectifier SCR3 is from node H, through SCR3, to node B, through the series connected cathode filaments of gas discharge lamps GLl to GLn, to node N. If capacitor C4's charge is depleted by increased ionization currents in gas discharge lamps GLl to GLn, capacitor C6's charge is also depleted. Silicon controlled rectifier SCR2 then fires and sources current into capacitor C6, and the voltage at node B drops. Consequently, silicon controlled rectifier SCR3 cannot fire, and can no longer contribute to the cathode filament current. Silicon controlled rectifier SCR3 contributes to the filament current whenever silicon controlled rectifier SCR2's demand to source current into capacitor C6 decreases to below silicon controlled rectifier SCR3's predetermined firing point. This arrangement not only ensures that the cathode filaments always have a current source to heat them, it also decreases any unnecessary current flowing through the gas discharge lamp cathode filaments. When the modulating signal decreases below a predetermined minimum level, the charge on capacitor C10 starts to decay through resistors R15 and R16, and the voltage on C10 steadily decreases. As a result, the output of amplifier A3 decreases, and current flow through the light emitting element of optoisolator I3 decreases to a point where its associated phototransistor is in cutoff. Consequently, current flow through silicon controlled rectifier SCR3 decreases to zero. This feature is useful when it is desirable to have AC mains remain connected to the present invention while controlling it with only the modulating signal. This feature decreases the total power consumption to less than 2 watts after the modulating signal has decreased to below a predetermined value.

An amplifier A2, resistors R10 and R14, and a capacitor C8 comprise a buffered differentiator circuit. Amplifier A2 receives its input from a differentiator circuit comprised of resistor R14, capacitor C8, and resistor R10. Capacitor C8 and resistor R14 are connected to the output of amplifier A4 through diode D6. In a quiescent condition (modulating signal voltage=0.0 V) capacitor C8 is discharged by resistor R14. Upon application of a modulating signal of a predetermined minimum level, the output of amplifier A4 immediately approximates the positive supply rail due to its high gain, and capacitor C8 begins to charge through resistor R10. As current flows through resistor R10, there is a voltage drop across resistor R10. This steadily declining voltage, the decay rate of which is determined by the values of capacitor C8 and resistor R10, is present for some time after the application of the modulating signal. The output of amplifier A2 is connected to the light emitting element of optoisolator I2 through a resistor R9. As long as the output of amplifier A2 exceeds the forward voltage drop of the light emitting element of optoisolator I2, there is current flow through that element. The output of optoisolator I2 controls a series of elements, described below, employed to provide the initial ionization potential of the gasses in gas discharge lamps GLl to GLn.

A silicon controlled rectifier SCR1, a transformer T2, a capacitor C5, in conjunction with a resistor R7, a diode D4, an optoisolator I10, a capacitor C47, and a resistor R8, provide initial ionization of gas discharge lamps GLI to GLn. Capacitor C5 is charged through diode D4, the light emitting element of optoisolator I10, and resistor R7, to peak line voltage positive with respect to neutral. This positive voltage is connected to the anode of silicon controlled rectifier SCR1. For the duration of optoisolator I2's "on" state, the voltage at capacitor C5's positive terminal is applied to the gate of silicon controlled rectifier SCR1 through resistor R8 and through the photoconductive element of optoisolator I2. Until capacitor C5 is charged to peak line voltage, current continues to flow through the light emitting element of optoisolator I10. Capacitor C47 keeps current flowing through optoisolator I10 between half-cycles. This results in a shunting ofthe gate-cathode junction of silicon controlled rectifier SCR1, thereby preventing premature firing of SCR1. Thus, silicon controlled rectifier SCR1 fires when the voltage on capacitor C5 reaches peak line voltage and optoisolator I2 is in a conductive state. After silicon controlled rectifier SCR1 fires, the charge on capacitor C5 is depleted, and the charge/discharge cycle begins again. The maximum firing frequency is determined by the time constant of resistor R7 and capacitor C5. The large current spike in the primary of transformer T2 causes a high voltage to be induced in T2's secondary. This output voltage at node C, positive with respect to neutral, is connected through resistive elements to the anodes of gas discharge lamps GLl to GLn. Thus, the lamps are fired many times when the modulating signal is first applied, and also after the modulating signal has not been present for some time. It is only necessary to re-fire the lamps if the filament current has been reduced to below the minimum current necessary for the filaments to sustain electron emission. Thus, the time constant of C10 (R15+R16) is much longer than the time constant of C8 R14.

After establishing operating parameters of the gas discharge lamps, light outputs of the gas discharge lamps are now capable of being modulated by the filters and modulating circuitry. The filters consist of a series of cascaded multiple feedback bandpass filters. This series employs staggering of each individual filter circuit's center frequency. These staggered frequency values are geometrically calculated for a flat response over the series' bandpass.

Since there is a plurality of identical filter series, voltage to current converters, and lamp modulation circuits, the following description will apply to all aforementioned circuits.

Separation of individual frequency bands contained in the input modulating signal is accomplished by operational amplifiers A5, A6, and A7. Amplifier A5, in conjunction with resistors R17, R18, R19, and capacitors C11 and C12, comprise a multiple feedback bandpass filter. Amplifiers A6 and A7 and their associated circuitry are identical to A5 and its asociated circuitry with the exception of component values chosen to tune a specific center frequency for each filter. The attenuated modulating signal at node E is connected to amplifier A5 through resistor R17. Amplifier A5 provides its output to the input of amplifier A6. Amplifier A7 receives amplifier A6's output, and amplifier A7's output is that portion of the input modulating signal that represents the tuned range of amplifiers A5, A6, and A7 acting as bandpass filters.

Translation of the individual modulating signals from the filters into control signals for the gas discharge lamp modulating circuitry is accomplished by an operational amplifier A8, a resistor, R26, and an AC input optoisolator I4. The output from amplifier A7 is connected to input of amplifier A8. Amplifier A8, together with resistor R26, comprise a voltage-to current converter. This voltage-to-current convertor is essentially a bi-directional no-loss rectifier with output current determined by the input voltage to amplifier A8 divided by the value of resistor R26. Consequently, the current into the light-emitting elements of optoisolator I4 is directly proportional to the input voltage at amplifier A8. Not only does this arrangment provide a linear relationship between the modulating signal voltage and optoisolator control current, it also provides a means of overcoming the forward biased diode drops in the light emitting elements of I4. This is effected by monitoring the current through the light emitting elements of I4 with the inverting input of amplifier A8. As current through the light emitting element of optoisolator I4 is modulated, I4's photoconductive element proportionally changes its ability to conduct. Current flow through a resistor R27, optoisolator I4's photoconductive element, and the base of a transistor Q1 is modulated accordingly. A resistor R28 provides a minimum sustaining ionization current to insure continual ionization without the presence of a modulating signal. As Q1 base current is modulated, current through Q1 from collector to emitter is varied proportionally. Current flow from main ionization supply is from node D, through Q1 from collector to emitter, through a resistor R30, through diodes D7 and D8, through gas discharge lamp GLl anode to cathode, through diode D19 to neutral. Diodes D19 to D23 are necessary to prevent the ionization current from any one lamp from using the filament from a neighboring lamp as a path to neutral. Due to the phenomenon of negative resistance inherent in gas discharge lamps, a method of current limiting must be employed to prevent current runaway through output transistors Q1 to Qn. The circuits for every lamp are identical, therefore a discussion of the circuit which includes Q1 will suffice.

As positive ionization current flows from the emitter of Q1, it must flow through a resistor R30, diodes D7 and D8, GL1, diode D19, and ultimately to neutral. As current flows through resistor R30, R30 develops a voltage drop. When the voltage drop across resistor R30 exceeds the forward emitter-base diode drop voltage of transistor Q2, Q2 begins to conduct. The purpose of resistor R29 is twofold; it provides a current path to the base of Q2, and also prevents the main ionization current from flowing through the base-emitter junction of Q2. As a result of the on state of Q2, the emitter-base junction of Q1 is shunted to the extent of current limit equilibrium, which is determined by the value of resistor R30.

While preferred methods and embodiments of the present invention have been described, it is to be understood that the methods and embodiments described are illustrative only and the scope of the present invention is to be defined solely by the appended claims when accorded a full range of equivalence, many variations and modifications naturally occurring to those of skill in the art from a perusal hereof.

What is claimed is:

1. An apparatus for selectively modulating the light output of at least one hot cathode gas lamp having filaments therein, comprising:

a control device for receiving a modulation input signal and producing a control signal having a level that is optimal for a dynamic range of operation;

an active peak detector for receiving the control signal and outputting a proportional voltage proportional to a peak value of the control signal;

a current source for receiving the proportional voltage and outputting a heating current related to the proportional voltage for heating one filament of the at least one hot cathode gas lamp;

an ionization voltage supply for receiving a control voltage and producing an initial ionizing potential to the hot cathode gas lamp;

a filter for receiving the control signal, filtering the proportional voltage and outputting a filtered signal;

a controlled voltage multiplier for producing a main ionization voltage;

a modulating circuit for receiving the main ionization vol age and the filtered signal and providing an output current, which is proportional to the filtered signal, to drive the at least one hot cathode gas lamp; and the at least one hot cathode gas lamp receiving the output current and responding to the output current of the modulating circuit which coincides with the modulating signal, the cathode filament of the at least one hot cathode gas lamp providing a means of current limiting the controlled voltage multiplier.

2. A circuit according to claim 1 further comprising;

a differentiator for receiving the proportional voltage and providing the control voltage to the ionization voltage supply causing the ionization voltage supply to produce the initial ionization potential.

3. A circuit according to claim 1 further comprising an ionization discharge delay for providing a shunting signal to the ionization voltage supply for delaying the outputting of the initial ionization potential from the ionization voltage supply to insure maximum potential of the initial ionization potential.

4. A circuit according to claim 3 wherein the ionization discharge delay further comprising an optocoupling element, a resistive element, and a capacitive element for delaying the outputting of the initial ionization potential until tne capacitive element in the ionization discharge delay is charged to a peak potential.

5. A circuit according to claim 1 wherein the ionization voltage supply further comprising an optocoupler element for receiving the proportional signal and controlling a silicon controlled rectifier in the ionization voltage supply to produce the initial ionization potential.

6. A circuit according to claim 1 wherein the modulating circuit further comprising a voltage-to-current converter, the input of which is connected to the output of the filter, the output of the voltage-to-current converter being connected to a light emitting element of an AC-input optocoupling element, and the output of the AC-input optocoupling element controlling the modulating circuit.

7. A circuit according to claim 1 wherein the current source further comprising a silicon controlled rectifier, the gate of which is connected to an output element of an optocoupling element, the light emitting element of the optocoupling element being driven by a buffer, the input of the buffer receiving the proportional voltage fcr producing the initial ionization potential.

8. A circuit according to claim 1 wherein the controlled voltage multiplier further comprising a silicon controlled rectifier electrically coupled to capacitors for controlling the charging of said capacitors to produce the main ionization voltage for the at least one hot cathode gas lamp.

9. A circuit according to claim 1 wherein more than one hot cathode gas lamp being connected in parallel each having one filter for receiving the control signal and outputting a filtered signal to a modulating circuit producing an output current to drive and to analogously vary the light output of each hot cathode gas lamp and having a rectifier element connected between each hot cathode gas lamp cathode filament to prevent the output current of one hot cathode gas lamp from being connected to neutral by a cathode filament of a neighboring hot cathode gas lamp.

10. A method for selectively modulating the light output of at least one hot cathode gas lamp having filaments therein, comprising:

producing a controlling signal from an input modulation signal, the controlling signal having a level that is optimal for a dynamic range of operation from a modulation input signal;

producing a proportional voltage from the controlling signal proportional to a peak value of the control signal;

producing a heating current from the proportional voltage related to the proportional voltage for heating at least one filament of the at least one hot cathode gas lamp;

producing an initial ionization potential from the proportional voltage for initializing the ignition of the at least one hot cathode gas lamp;

filtering the control signal and outputing a filtered signal;

producing a main ionization voltage; and modulating the main ionization voltage and the filtered signal and providing an output current, which is proportional to the filtered signal, to drive the at least one hot cathode gas lamp, the cathode filament of the at least one hot cathode gas lamp providing a means of current limiting the main ionization voltage.

11. A method according to claim 10 wherein the step of producing a current further comprising;

differentiating the proportional voltage and controlling the production of the proportional voltage.

12. A method according to claim 10 further comprising the step of;

delaying the discharge of the initial ionization potential by providing a shunting signal for the production of the ionization potential for delaying the outputting of the initial ionization potential to insure maximum potential of the initial ionization potential.

13. A method according to claim 10 wherein more than one hot cathode gas lamp being connected in parallel with each of the more than one hot cathode gas lamp receiving an output current to drive and to analogously vary the light output of each one of the more than one hot cathode gas lamp and further comprising the step of;

rectifying each output of the more than one hot cathode gas lamp for preventing the output current of one hot cathode gas lamp from being driven low by a cathode filament of a neighboring hot cathode gas lamp.

14. An apparatus for selectively modulating the light output of at least one hot cathode gas lamp, having filaments therein, comprising:

a control means for receiving a modulation input signal and producing a control signal having a level that is optimal for a dynamic range of operation;

an active peak detector means for receiving the control signal and outputting a proportional voltage, proportional to a peak value of the control signal;

a current source means for receiving the proportional voltage and outputting a heating current related to the proportional voltage for heating a filament of the at least one hot cathode gas lamp;

an ionization voltage supply means for receiving the a control voltage and producing an initial ionizing potential to the hot cathode gas lamp;

a filter means for receiving the control signal, filtering the proportional voltage and outputting a filtered signal;

a controlled voltage multiplier means for producing a main ionization voltage;

a modulating means for receiving the main ionization voltage and the filtered signal and providing an output current, which is proportional to the filtered signal, to drive the at least one hot cathode gas lamp; and the at least one hot cathode gas lamp receiving the output current and responding to the output current of the modulating means which coincides with the modulating signal, the cathode filament of the at least one hot cathode gas lamp providing a means of current limiting the controlled voltage multiplier means.

15. An apparatus according to claim 14 further comprising;

a differentiating means for receiving the proportional voltage and providing the control signal to the ionization voltage supply means causing the ionization voltage supply to produce the initial ionization potential.

16. An apparatus according to claim 14 further comprising an ionization discharge delay means for providing a shunting signal to the ionization voltage supply means for delaying the outputting of the initial ionization potential from the ionization voltage supply means to insure maximum potential of the initial ionization potential.

17. An apparatus according to claim 14 wherein the modulating means further comprising a voltage-to-current converter means, the input of which is connected to the output of the filter means, the output of the voltage-to-current converter means being connected to a light emitting element of an AC-input optocoupling element, and the output of the AC-input optocoupling element controlling the modulating means.

18. An apparatus according to claim 14 wherein the current source means further comprising a silicon controlled rectifier, the gate of which is connected to an output element of an optocoupling element, the light emitting element of the optocoupling element being driven by a buffer, the input of the buffer receiving the proportional voltage for producing the initial ionization potential.

19. An apparatus according to claim 14 wherein the controlled voltage multiplier means further comprising a silicon controlled rectifier electrically coupled to capacitors for controlling the charging of said capacitors to produce the main ionization voltage for the at least one hot cathode gas lamp.

20. An apparatus according to claim 14 wherein more than one hot cathode gas lamp being connected in parallel each having a filter means for receiving the control signal and outputting a filtered signal to a modulating means producing an output current to drive and to analogously vary the light output of each hot cathode gas lamp and having a rectifier means connected between each hot cathode gas lamp to prevent the output current of one hot cathode gas lamp from being connected to neutral by a cathode filament of another hot cathode gas lamp.

21. An apparatus for selectively modulating the output of a series of filaments having electrical junctions, comprising:

a current source connected to the electrical junctions for providing initial heating of the series of filaments, a controlled voltage multiplier connected to the electrical junctions for producing a main ionization voltage and current;

the filaments having a resistance for providing a means of current limiting the controlled voltage multiplier; and at least one rectification element connected to at least one of the electrical junction of the filaments, the rectification element preventing the output of one filament from entering a neighboring filament.

22. A circuit according to claim 21 wherein the filaments are gas discharge lamp filaments and the modulation of each gas discharge lamp is implemented by means which cause modulation to occur during both positive and negative half-cycles of a modulating signal input.

23. A circuit according to claim 22 wherein modulation of each gas discharge lamp is implemented by a bipolar optocoupler element in conjunction with a voltage to current converter.

24. A circuit according to claim 22 wherein the current source implemented for initial heating of gas discharge lamp filaments is implemented by a circuit comprised of a current controlling element.

25. A circuit according to claim 22 wherein the controlled voltage multiplier further comprising a current controlling element electrically coupled to capacitors for controlling the charging of said capacitors to produce the main ionization voltage and current for a plurality of gas discharge lamps.

26. A circuit according to claim 22 wherein the controlled voltage multiplier is electrically connected to the plurality of series connected gas discharge lamp cathode filaments such that any current flowing into the controlled voltage multiplier must pass through the cathode filaments of a plurality of series connected gas discharge lamps.

27. A circuit according to claim 22 wherein the current source is electrically coupled and controlled by a peak detector, which is in turn controlled by the modulating input signal.

28. An apparatus for selectively modulating the light output of gas discharge lamps having cathode filaments therein, comprising:

at least two series connected gas discharge lamp cathode filaments, connected such that electrical junctions are created between the series connected gas discharge lamp cathode filaments; and at least one rectification element connected to at least one of the electrical junctions of the cathode filaments of the gas discharge lamps, thereby preventing an output current of one gas discharge lamp from flowing to either side of a cathode filament of a neighboring gas discharge lamp.

* * * * *